United States Patent [19]

Kobayashi et al.

[11] Patent Number: 4,998,577

[45] Date of Patent: Mar. 12, 1991

[54] DEVICE FOR STABILIZED OPENING AND CLOSING OF A SLIDING PANEL

[75] Inventors: Mitsuru Kobayashi, Komagane; Hori Keishirou, Ina, both of Japan

[73] Assignee: Toyo Exterior Kabushiki Kaisha, Tokyo, Japan

[21] Appl. No.: 429,362

[22] Filed: Oct. 31, 1989

[30] Foreign Application Priority Data

Aug. 31, 1989 [JP] Japan ..... 1-225052

[51] Int. Cl.[5] ..... E05D 15/06

[52] U.S. Cl. ..... 160/202; 160/197

[58] Field of Search ..... 160/202, 201, 196.1, 160/197, 211, 221, 223, 188, 26, 32, 33, 199; 49/125, 127, 128

[56] References Cited

U.S. PATENT DOCUMENTS 1,960,860 5/1934 Allen ..... 160/197 X
3,494,407 2/1970 Hollands et al. ..... 160/199
3,577,679 5/1971 Petterborg ..... 49/127
4,569,164 2/1986 Dickson ..... 49/127 X

FOREIGN PATENT DOCUMENTS 1-116183 5/1989 Japan .

*Primary Examiner*—David M. Purol
*Attorney, Agent, or Firm*—Wenderoth, Lind & Ponack

[57] ABSTRACT

A device for stabilized opening and closing of a sliding panel includes a gear-like driving roller made of synthetic resin and provided with a number of low profile teeth arranged with a fin and constant pitch. The driving roller is arranged on the inside of the device and a pinch roller is arranged on the outside of the device in juxtaposition with the driving roller. A rack-like plate made of synthetic resin and arranged horizontally all the way along on the inner side wall of a sliding panel is engaged with and driven by the driving roller. A biasing device arranged at least on one of the driving roller or the pinch roller biasing it toward the sliding panel.

5 Claims, 4 Drawing Sheets

DEVICE FOR STABILIZED OPENING AND CLOSING OF A SLIDING PANEL

BACKGROUND OF THE INVENTION

1. Field of the Invention

This invention relates to a device for stabilized opening and closing of a sliding panel that can be used for a fully openable and collapsible door for partitioning a building, a rain shutter or a gate door exposed to rain water.

2. Prior Art

A device for automatically opening and closing a sliding panel of the above mentioned category has been proposed in Japanese Patent Application No. 62-272542.

Such device includes a rubber cylindrical driving roller rotatable both clockwise and counterclockwise and driven by a motor and a cooperating rubber cylindrical pinch roller arranged in contact with the driving motor. For example, a horizontal reinforcing member of a sliding panel made of aluminum alloy is pinched between the two rollers and forcedly moved away or back to open or close the sliding panel as the driving roller is rotated in opposite directions.

However, such device is accompanied by a drawback that it cannot smoothly open or close a sliding door, since the driving roller idly rotates without effectively moving the sliding door, even through the rubber of the rollers provides sufficient friction against the sliding panel pinched therebetween. Attempts for improving the performance of such a device by changing the distance between the two rollers that press and hold a sliding panel have proved to be unsuccessful.

Such a device provides a poor performance particularly when it is applied to a large sliding door, a heavy gate door, a collapsible sliding door constituted by a large number of panels or a slide panel with a heavy load, indicating that this particular drawback has to be eliminated if such a device is made feasible for practical applications.

It is therefore an object of the present invention to provide a device for enabling stabilized opening and closing of a sliding panel that ensures smooth opening and closing operation regardless of the type of the door to which it is applied.

The present inventors, as a result of intensive research efforts, came to find that the driving roller of such a device becomes idle when the area of the sliding panel pressed and held by the driving and pinch rollers is wet due to dew drops, rain water or moisture in the atmosphere, which conditions nullify the effect of frictional resistance of the rubber driving roller against a sliding panel made of aluminum alloy, steel or synthetic resin, even though the frictional resistance is of a sufficient magnitude for opening and closing such a sliding panel.

SUMMARY OF THE INVENTION

According to the invention, which is based on the above findings that a sliding panel inevitably will have moisture on it, the above object and other objects of the present invention are achieved by providing a device for opening and closing a sliding panel of the above described category, wherein the driving roller for driving the sliding panel is arranged inside of the panel and is in the form of a gear made of synthetic resin which is disengageably engaged with a rack also made of synthetic resin and arranged on the inner side wall of the sliding panel. More specifically, according to the invention, there is provided a device for stabilized opening and closing of a sliding panel comprising a gear-like driving roller made of synthetic resin and provided with a number of low profile teeth arranged with a fine and constant pitch, such driving roller being arranged on the inside of the device, a pinch roller arranged on the outside of the device in juxtaposition with the driving roller, a rack-like plate made of synthetic resin and arranged horizontally all the way along on the inner side wall of the sliding panel for being engaged with and driven by the driving roller and a biasing means arranged at last on either the driving roller or the pinch roller for biasing it toward the sliding panel. In a preferred embodiment of the device for stabilized opening and closing of a sliding panel according to the present invention, a number of sequentially connected identical sliding panels, each provided with a rack-like plate, constitute a collapsible sliding door and each rack-like plate is arranged on the inside of an upper horizontal portion of a reinforcing frame of the respective sliding panel, the driving roller and the pinch roller being rigidly fitted to an upper guide rail of the sliding panels at or near a door storage area therefor.

Since the gear-like driving roller according to the present invention is driven by a motor and engaged with the rack-like plate on the sliding panel in such a manner that the sliding panel is moved either way along its path, the operation of the device practically is not effected by the presence of any moisture on the sliding panel that may result from dew drops, rain water or any other phenomena.

Moreover, with a device for stabilized opening and closing of a sliding panel according to the present invention, when a person or an object comes in the path of the sliding panel and hinders its movement, the driving roller rotates idly to prevent the sliding panel from pressing too hard against the obstacle, as a result of the structural features of the device including the biasing means, the fine pitch of the teeth of the driving roller made of synthetic resin and the low profile of the teeth that can be easily repelled away from their counterparts of the rack-like plate, thus resulting in the device being a fail-safe system.

The present invention now will be described in greater detail by referring to the accompanying drawings that illustrate a preferred embodiment of the invention.

DETAILED DESCRIPTION OF THE INVENTION

Figure 1:
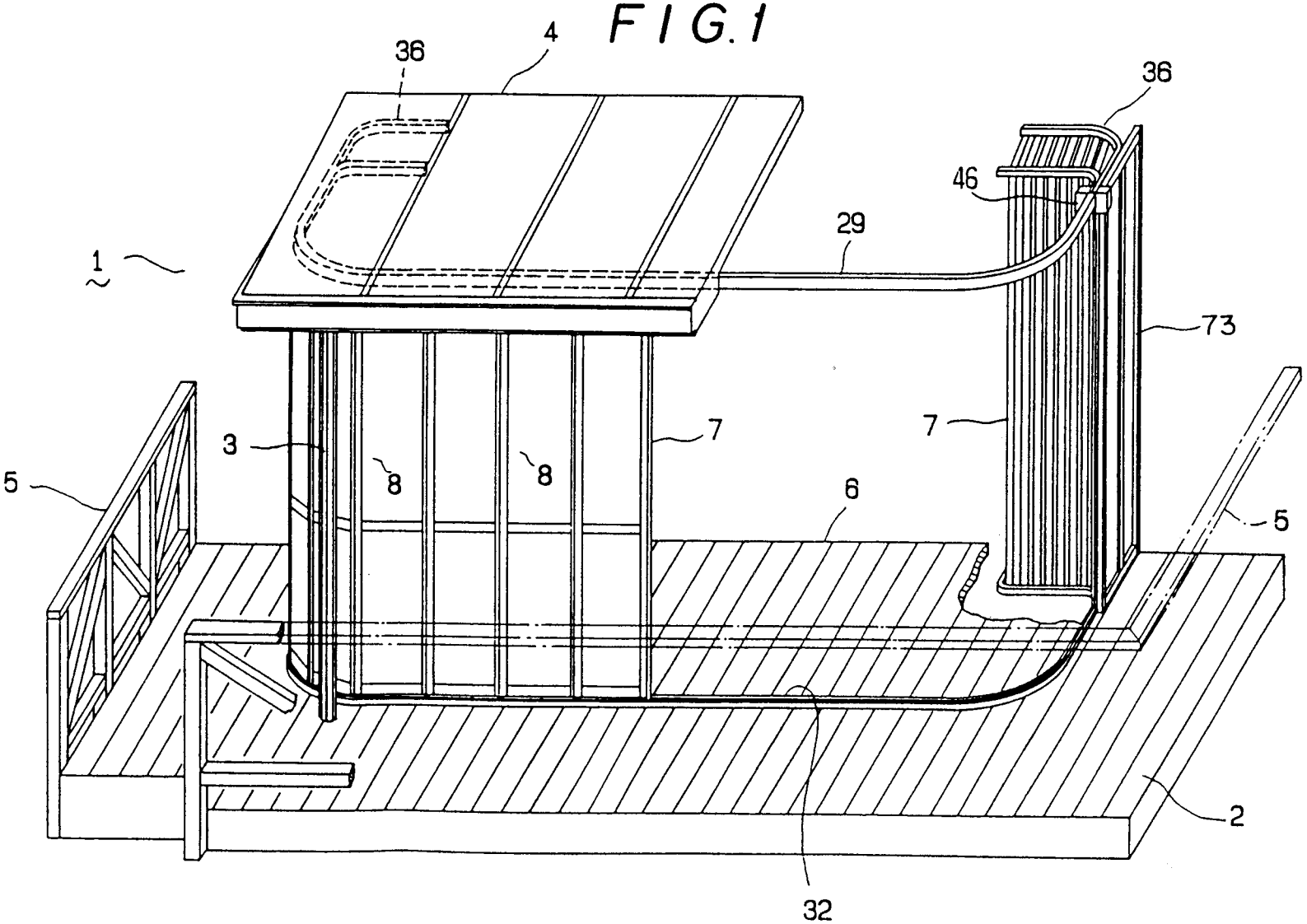
FIG. 1 is a partially exploded perspective view of a fully openable type sun parlor provided with a device according to the present invention.
Figure 2:
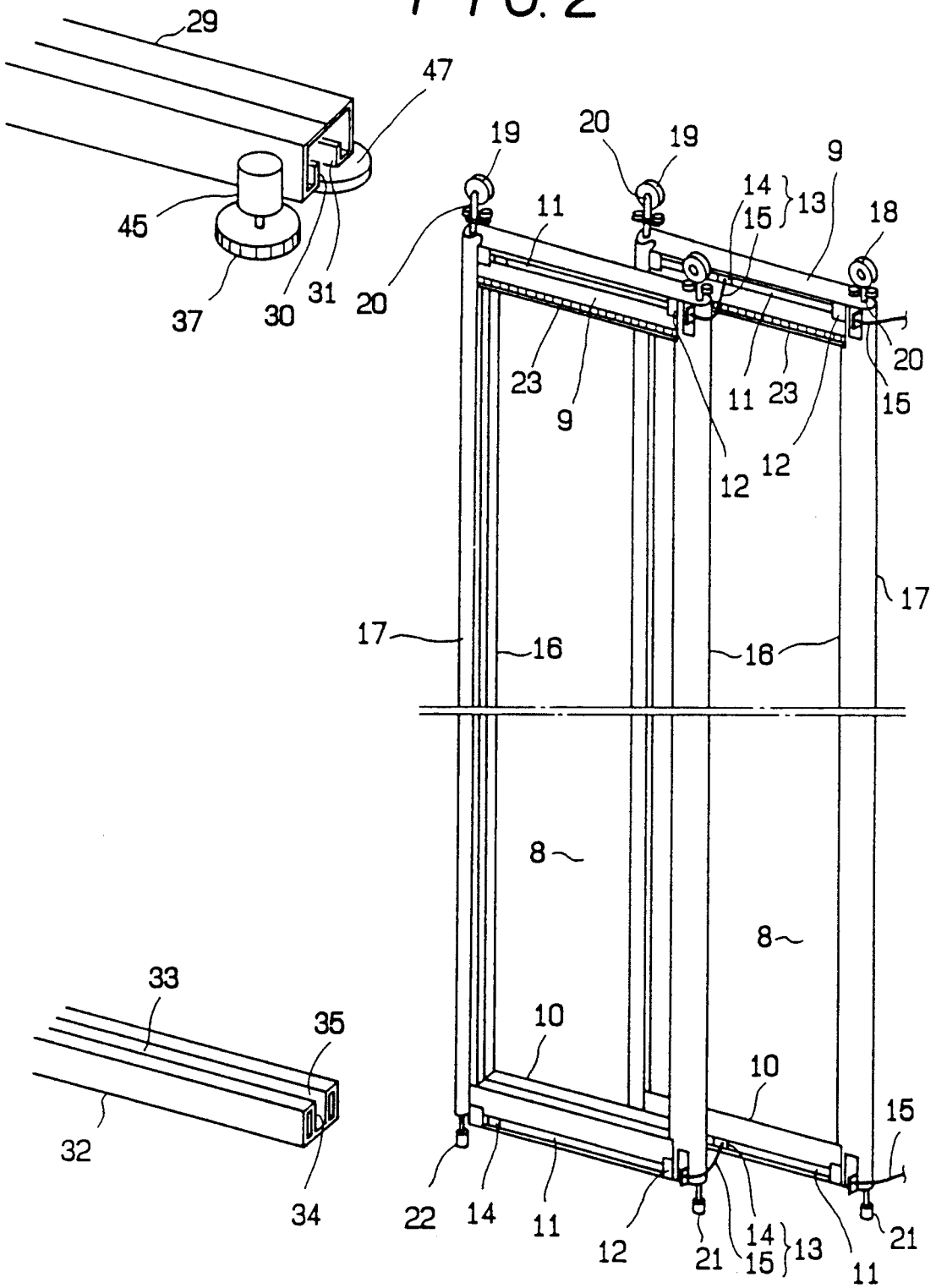
FIG. 2 is an exploded perspective view of a pair of sliding panels illustrating how they are connected with each other.
Figure 3:
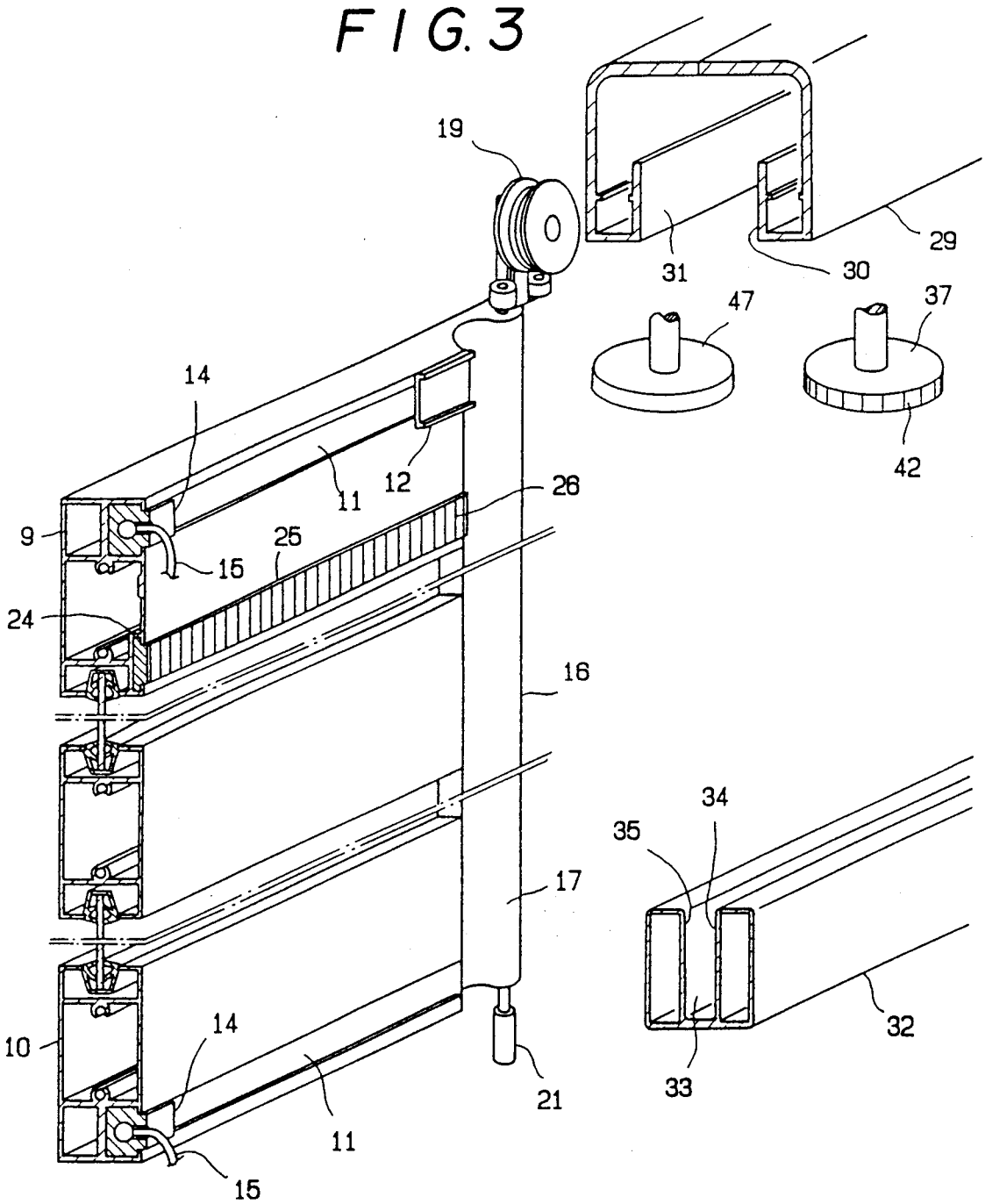
FIG. 3 is a partially exploded perspective view of a sliding panel illustrating the relationship between the sliding panel and a driving roller in the illustrated embodiment.
Figure 4:
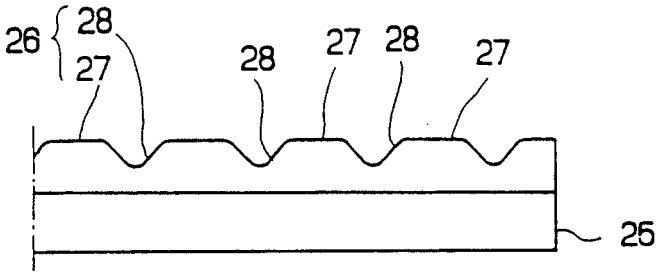
FIG. 4 is an enlarged partial side view of a rack-like plate showing some of its teeth.
Figure 7:
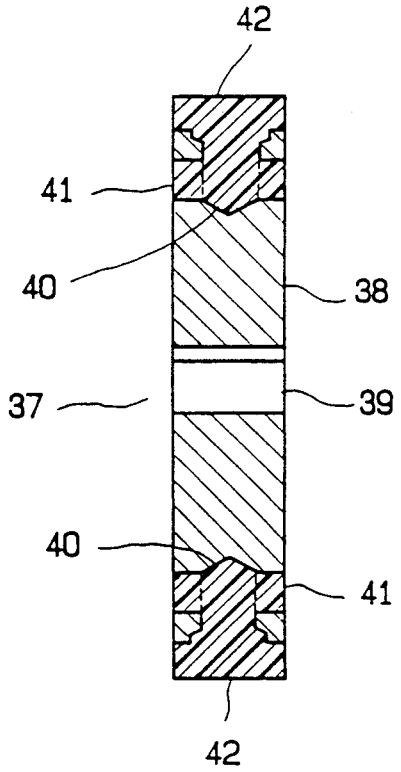
FIG. 7 is a radial sectional view of the driving roller of FIG. 6.
Figure 5:
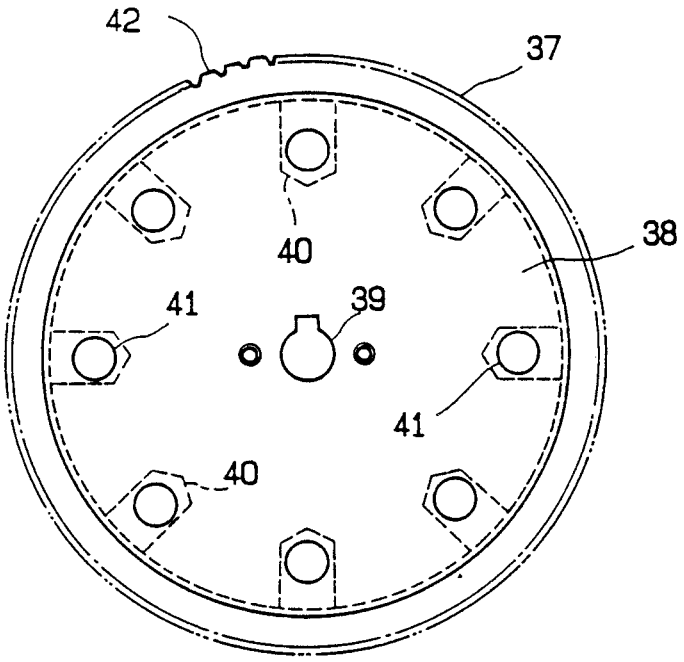
FIG. 5 is a front view of the driving roller of FIG. 3.
Figure 6:
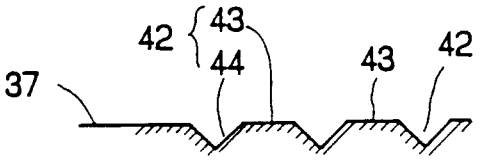
FIG. 6 is an enlarged partial sectional view of the driving roller of FIG. 5 showing some of its teeth.

In the accompanying drawings, reference numeral 1 generally denotes a fully openable type sun parlor having a collapsible sliding door assembly provided with a device for enabling stabilized opening and closing of a sliding panel according to the present invention. The collapsible sliding door assembly comprises a number of pillars 3, a roof 4 supported by pillars 3 and rigidly fitted to a wall of a main building to which it is attached, a U-shaped horizontal upper guide rail 29 fitted to the lower surface of the roof 4, a horizontal lower guide rail 32 having a configuration similar to that of the upper guide rail 29, and a pair of collapsible sliding doors 7 to be moved in opposite directions for opening and closing operations.

Each of the collapsible sliding doors 7 is constituted by a number of sequentially and separably connected sliding panels 8 such that the door 7 can be totally collapsed. In the illustrated embodiment, any two adjacent sliding panels 8 are connected with each other by means of upper and lower movable connector sets 13 and auxiliary connecting means for engagedly connecting rear and front side frames 16 of the two succeeding panels 8.

More specifically, each sliding panel 8 is reinforced by an upper horizontal member 9 and a lower horizontal member 10, each of such members having a guide channel 11 in it running all the way along the side wall of the member and facing the inside of the sun parlor 1. A slider 14 made of a resin block is introduced into each respective channel 11 by way of an enlarged opening at an end of the corresponding member such that it is slidably contained in guide channel 11 when such opening is closed by a cap 12. Each slider 14 is then movably connected with the inside of the rear vertical member 16 by means of a wire 15 having a given length, slider 14 and wire 15 constituting a connector set 13. By appropriately defining the length of the wire 15, the two neighboring panels 8 can be brought into a totally collapsed condition without disconnecting the connector set 13.

The front and rear vertical members 16 of a panel are identically formed, each being provided with an engaging member 17 longitudinally running all the way along the vertical member 16 and having a C-shaped section such that the engaging member 17 of the rear vertical member 16 of one sliding panel 8 comes into engagement with its counterpart 17 combined with the front vertical member 16 of the succeeding panel 8. With such an arrangement, a force to pull the collapsible door 7 is effectively transmitted to all the sliding panels 8 of such door, whereas the engagement of any pair of engaging members 17 can be easily released when the door is collapsed.

Reference numerals 18 and 19 denote a pair of suspension roller arranged at the top of a sliding panel 8 for enabling suspended movement of the panel 8 and respectively fitted to the top portions of the vertical members 16 of the sliding panel 8 with a space provided between them. Each of suspension rollers 18 and 19 is vertically and rotatably supported by a post 20 upwardly projecting from the longitudinal center line of the upper member 9 in such a manner that the roller can be displaced inwardly or outwardly and pivoted around the post 20. It should be noted that, in the present embodiment, a pair of lower rollers 21 and 22 which are rotatable around their respective vertical shafts are respectively provided at the bottom portions of the vertical members 16, such that the lower rollers 21 and 22 are respectively located right beneath the suspension rollers 18 and 19.

On the other hand, each sliding panel 8 is provided with a rack-like plate 23 arranged horizontally just below and parallel with the guide channel 11 formed on the inner surface of the upper member 9.

In the present embodiment, since all the frame members of a panel 8 including the upper frame member 9 are made of aluminum alloy, rack-like plate 23 is integrally formed with a plate member 25 made of a hard nylon resin (6 nylon), which is rigidly fitted to the upper frame member 9.

More specifically, the upper frame member 9 of a sliding panel 8 is provided with a groove 24 having a C-shaped section and into which is inserted an oblong plate member 25 having an inverted T-shaped section from either end, in advance of assembly of the sliding panel, so that plate member 25 is rigidly held in the groove 24.

The oblong plate member 25 has a profile extending toward the inside of the sun parlor by approximately 13 mm with a thickness up to 4 mm and is provided on its outer surface with a rack 26 comprising vertically extending teeth 27 longitudinally arranged along the entire length of the plate with a fine pitch of 2 mm and spaces each formed between two neighboring teeth, the teeth being 1 mm high from the bottom of the spaces, and the teeth having outwardly diverging flank surfaces.

In other words, the bottom of each space has roughly a rounded V-shaped sectional configuration with a depth of 0.5 mm, while each tooth has an inverse V-shaped sectional configuration with a height of 0.5 mm.

A predetermined number of sliding panels having a configuration as described above are serially connected to form a door 7 which is suspended by the upper guide rail 29 and supported by the lower guide rail 32 arranged near the front and side edges of a sun parlor 1 so that the sliding panels can be slidably moved along the guide rails by means of a device for stabilized opening and closing of the sliding panels, e.g. a motor 45. Such movement may be into a door storage area 36 to make the sun parlor wide open and reversely out of the door storage area to close the sun parlor.

The device for stabilized opening and closing of sliding panels in this embodiment comprises motor 45 provided with a reduction gear, a driving roller 37 accommodated in a case 46 with said motor 45 and driven by the motor to rotate around an axle fitted to the case, and a pinch roller 47 also accommodated in the case 46. The case 46 is arranged on the upper guide rail 29 at or near the door storage area 36 in such a manner that the driving roller 37 is positioned inside of the sun parlor while the pinch roller 47 is located outside of the sun parlor.

The driving roller 37 can be driven either clockwise or counterclockwise by motor 45 and has an indented surface area configuration on its periphery made of synthetic resin to provide a gear-like form.

In this embodiment, the driving roller 37 is formed by coating the periphery of a disc-like main body 38 of cast aluminum alloy having a diameter of 30 cm and a thickness of 2 cm with a highly abrasion- and weather-resistant urethane resin material having a hardness of 70°.

The disc-like main body 38 has a central through bore 39 for rigidly receiving an axle as well as eight recessed areas 40 separated equally by 45° on each axial surface (upper or lower surface when the device is properly installed). The recessed areas on one surface are in communication with corresponding recessed areas on the other surface by through bores 41 through body 38. With such an arrangement, when the main body 38 is coated with urethane resin by injecting molten resin into a mold that surrounds the main body, the recessed areas and the through bores are also filled with resin so that a unique and integral urethane resin structure is formed, thereby to prevent any dislocation of the coating once it is hardened.

Teeth are also formed on the periphery of the driving roller 37, such teeth having a height of 1 mm with a fin pitch of 2 mm at the time of injection molding. Thus, the driving roller 37 is provided with an indented periphery 42 formed by a number of teeth 43 and an equal number of spaces 44 between the teeth, which teeth and spaces are alternately arranged.

While each of the spaces 44 between the teeth 43 of the intended periphery of the driving roller 37 roughly has a V-shaped sectional shape, each of the teeth 43 has an inverted V-shaped sectional shape, i.e. defined by outwardly diverging flank surfaces.

The driving roller 37 is biased by a biasing means toward the sliding panel 8, i.e. toward the outside of the sun parlor 1. While the biasing means is not illustrated in the accompanying drawings, it may be configured as described in Japanese Patent Application No. 62-272542. In other words, the case 46 is fitted to the upper guide rail 29 by means of a hinge, while the upper surface of the case 46 is pressed downward by a spring arranged in a stationary frame located above the case, and at the same time the case 46 is held by the stationary frame in such a manner that the driving roller 37 can be slightly pivoted to shift its position. A universal joint, which is not shown, is provided between the axle of the driving roller 37 and the axle of the motor 45, to effectively maintain the connection therebetween even when the driving roller 37 is displaced relative to the motor 45 under the influence of the biasing means.

The pinch roller 47 is also formed by coating a disc-like main body with urethane resin, while its periphery is made flat without any teeth on it.

The driving roller 37 and the pinch roller 47 are so arranged that they tightly hold a sliding panel 8 at the upper frame member 9 thereof from opposite lateral sides, and that the driving roller 37 is engaged with the rack-like plate 23 of the sliding panel 8. Rotation of the driving roller 37, which is biased toward the sliding panel 8, opens or closes the sliding panel 8.

When the movement of a sliding panel 8 is blocked by an obstacle, roller 37 is idly rotated, to avoid any damage to any of the components of the door assembly as described earlier, since the indented periphery 42 of the driving roller 37 and the rack 26 of the plate 23 are repelled from each other. Further, the driving roller 37 and the rack-like plate 23 can easily and smoothly be restored to their mutual engagement due to the profile of the respective indented areas thereof.

The door storage area 36 of the illustrated embodiment is formed by extending the upper guide rail 29 and the lower guide rail 32, with inner and outer guide rail members 30 and 31 of the upper guide rail 29 being separated from each other and roundly bent to form a pair of arc each equal to a quarter of a circle so that they are eventually directed perpendicular to the guide rail 29. Inner and outer side walls 34 and 35 of a groove 33 of the lower guide rail 32 are also separated from each other and roundly bent to form a pair of arcs each equal to a quarter of a circle in such a manner that the radius of curvature of the arc of the outer guide rail member 31 of the upper guide rail 29 and that of the arc of the outer side wall 35 are respectively greater than the radius of curvature of the arc of the inner guide rail member 30 of the upper guide rail 29 and that of the arc of the inner side wall 34 of the lower guide rail 32, thereby ensuring smooth movement of the suspension rollers 18 and 19 which are slightly deviated from the lateral center line of the sliding panel 8 and of the vertical rollers 21 and 22 located on the lateral center line of the sliding panel 8, and smooth movement of the sliding panel 8 as a whole into or out of the storage area 36.

Reference numeral 5 denotes a balustrade and reference numeral 6 denotes the inside floor area of the sun parlor 1, while reference numeral 73 denotes a foldable and stationary panel provided at the outside of door storage area 36 to form a doorway when the collapsible double door assembly is completely closed.

While the present invention is described above by way of a preferred embodiment, the door may be realized in the form of a single and wide sliding panel in place of a number of serially connected sliding panels to be used for a sliding gate or door installed outdoors. Alternatively, the door may be realized in the form of one or more than one sliding panels to be used for a partition installed indoors. Such a sliding panel may be realized in the form of a blank panel, a sashed panel, or a panel provided with appropriate reinforcing or ornamental members.

The gear-like driving rollers is integrally formed by coating a disc-shaped main body with synthetic resin, and peripheral teeth are formed with a fine pitch and a low profile. The pitch of the teeth is preferably between 1 and 3 mm, while the height of the teeth is preferably between 0.5 and 2 mm.

While the peripheral teeth of the driving roller axially and continually run from edge to edge in the above embodiment, alternatively each of the teeth may have a broken area at or around the middle thereof. Still alternatively, the teeth may be formed in any other appropriate way so long as they are satisfactorily engaged with the rack-like plate.

While the toothed periphery of the driving roller is made of urethane resin in the above embodiment in view of the excellent abrasion-resistant of such material, it alternatively may be made of nylon, vinyl chloride or other appropriate synthetic resin materials so long as such alternatives are feasible in terms of the size of the sliding panel, the load applied to it and other conditions.

While the pinch roller in the above embodiment is realized in the form of a disc having a smooth peripheral surface, it may be provided with teeth as is the driving roller, a corresponding rack-like plate also being provided on the outer surface of the sliding panel so that the pinch roller and such rack-like plate come to mutual engagement. Such an arrangement will be particularly effective when the sliding panel is subjected to a heavy load.

The driving roller and the pinch roller may be suspended from above or fitted to a pole extending upwardly from the floor. They are not necessarily placed at or near the upper guide rail.

While the driving roller can be pivotally displaced for idle rotation and is biased toward the sliding panel in the above embodiment, the pinch roller alternatively or additionally may be biased toward the sliding panel or toward the inside of the sun parlor.

For biasing the pinch roller, the upper or lower half or both of the axle of the pinch roller may be replaced by a or a pair of links which are biased toward the guide rail by a or a pair of springs.

On the other hand, the rack which is engaged with the driving roller may be configured appropriately so long as it comes into a good engagement with the driving roller. In other words, the upper, middle or lower horizontal frame member of the sliding panel that is placed vis-a-vis the driving roller may be realized in the form of a rack which is made of synthetic resin and becomes an integral part of the sliding panel.

When the rack-like plate is prepared separately, it may be bonded to the sliding panel by adhesive, through mutual engagement, by means of screws or by using other appropriate binding technique.

As is apparent from the above description, the material, the shape, the structure and the size as well as the position of the driving roller, the pinch roller, the rack-like plate, the sliding panel, the biasing means and other components of the present invention may be modified and/or altered independently or in combination thereof within the spirit and the scope of the invention.

The device according to the invention ensures smooth and stabilized opening and closing motion of the sliding panel regardless of the existence of dew drops and/or rain water on the inner surface of the sliding panel, because the driving roller is engaged with the rack-like plate arranged on the sliding panel.

Moreover, the device according to the invention constitutes a fail-safe mechanism that meets both stability and safety requirements of a powered opening and closing device of a sliding panel of this category, because the driving roller is made of synthetic resin and is provided with teeth of a fine pitch and a low profile and because it is biased toward the sliding panel in such a way that it starts to rotate idly whenever the movement of the sliding panel is blocked by an obstacle.

Further, the device according to the invention ensures smooth and stabilized movement of the sliding panel even when a rack-like plate cannot be arranged near the lateral edges of the sliding panel because of its structural restrictions, since the driving roller can be idly and noiselessly rotated when it is out of engagement with the rack-like plate.

Finally, since the device according to the invention is structurally simple, it can carry out smooth and stabilized operations of opening and closing sliding panels for a prolonged period of time.

What is claimed is:

1. In a collapsible sliding panel assembly including a plurality of individual sliding panels movable along at least an upper guide rail between a closed position whereat said panels extend sequentially along said guide rail and an open position whereat said panels are brought into adjacent parallel alignment at a storage location, and means for moving said panels along said guide rail between said open and closed positions, the improvement wherein said moving means comprises:

a plurality of rack-like plates, one said rack-like plate being mounted on an upper portion of a first side of each said panel and extending along substantially the entire horizontal length thereof, each said rack-like plate having vertical teeth extending outwardly from said first side of the respective said panel;

a driving roller mounted on said guide rail at a position adjacent said storage location, said driving roller having on a periphery thereof vertical teeth, and said driving roller being positioned on said first side of said panels with said teeth of said driving roller engaged with said teeth of said rack-like plate of one of said panels;

a motor mounted in cooperative driving relationship for rotating said driving roller in opposite directions about a vertical axis, and thereby for causing said teeth of said driving roller to successively engage with said teeth of said rack-like plates of adjacent said panels, thus moving said panels in opposite directions along said guide rail; and a pinch roller mounted on said guide rail at a position opposed to said driving roller and in contact with a second side of one said panel, thereby to ensure that said teeth of said rack-like plates on said first sides of said panels are maintained in engagement with said teeth of said driving roller during movement of said panels along said guide rail by said driving roller.

2. The improvement claimed in claim 1, wherein said teeth of said rack-like plates and of said driving roller are formed of an abrasion resistant synthetic resin material.

3. The improvement claimed in claim 2, wherein said driving roller comprises a main body having around a periphery thereof a layer of said synthetic resin material defining said teeth of said driving roller.

4. The improvement claimed in claim 3, wherein said main body has therethrough a plurality of axially parallel bores, and said synthetic resin material fills said bores and thereby anchors said layer to said main body.

5. The improvement claimed in claim 1, wherein said teeth of said rack-like plates and of said driving rollers have outwardly diverging flank surfaces.

* * * * *